US008028974B2

(12) United States Patent
Mann

(10) Patent No.: US 8,028,974 B2
(45) Date of Patent: Oct. 4, 2011

(54) FENCE POST

(75) Inventor: Ronald Leslie Mann, Smithfield (AU)

(73) Assignee: Gram Engineering Pty Limited, Smithfield, NSW (AU)

( * ) Notice: Subject to any disclaimer, the term of this patent is extended or adjusted under 35 U.S.C. 154(b) by 73 days.

(21) Appl. No.: 12/296,943

(22) PCT Filed: Apr. 19, 2007

(86) PCT No.: PCT/AU2007/000500

§ 371 (c)(1), (2), (4) Date: Mar. 13, 2009

(87) PCT Pub. No.: WO2007/121507

PCT Pub. Date: Nov. 1, 2007

(65) Prior Publication Data

US 2009/0309085 A1 Dec. 17, 2009

(30) Foreign Application Priority Data

Apr. 21, 2006 (AU) ..... 2006902103

(51) Int. Cl.
*E04H 17/20* (2006.01)

(52) U.S. Cl. ..... 256/21; 256/DIG. 5

(58) Field of Classification Search ..... 256/21, 256/DIG. 5; 52/836–838
See application file for complete search history.

(56) References Cited

U.S. PATENT DOCUMENTS

| | | | | | |
|---|---|---|---|---|---|
| 2,169,254 | A | * | 8/1939 | Kotrbaty | 52/364 |
| 3,653,172 | A | * | 4/1972 | Schwartz | 52/669 |
| 3,738,083 | A | * | 6/1973 | Shimano | 52/584.1 |
| 4,075,810 | A | * | 2/1978 | Zakrzewski et al. | 52/588.1 |
| 4,240,615 | A | * | 12/1980 | Sickler | 256/60 |
| 4,369,953 | A | * | 1/1983 | Greiner et al. | 256/24 |
| 5,325,651 | A | * | 7/1994 | Meyer et al. | 52/715 |
| 5,628,495 | A | * | 5/1997 | Gandara | 256/24 |
| 6,935,075 | B2 | * | 8/2005 | Sherman | 52/79.1 |
| D566,299 | S | * | 4/2008 | Mann | D25/121 |

FOREIGN PATENT DOCUMENTS

| | | | |
|---|---|---|---|
| AU | 199454752 | A1 | 8/1994 |
| AU | 2003200119 | B2 | 7/2003 |
| AU | 2003242447 | A1 | 3/2005 |
| GB | 609276 | A | 9/1948 |
| GB | 2 139 666 | A | 11/1984 |

OTHER PUBLICATIONS

International Search Report; PCT/AU2007/000500.

* cited by examiner

*Primary Examiner* — Joshua Kennedy

(74) *Attorney, Agent, or Firm* — Ladas & Parry LLP

(57) ABSTRACT

There is provided a fence post having a web and locating elements for engagement with an end portion of a barrier panel. The web has opposite inner and outer surfaces, and is profiled to facilitate alignment of the fence post with another said post when those posts are arranged back to back with the outer surfaces of the webs in abutting relation. The web incorporates at least one longitudinal groove that in use provides a channel between the abutting webs of fence posts for drainage of water from between the posts. There is also provided an intermediate fence post assembly having two of the posts arranged back to back with their respective webs in abutting relation, as well as a fence incorporating a plurality of the fence posts and/or fence post assemblies.

16 Claims, 3 Drawing Sheets

FENCE POST

FIELD OF THE INVENTION

The present invention relates generally to fences of the kind comprising a plurality of spaced apart fence posts or post assemblies and barrier panels extending between, and supported by, neighbouring posts or post assemblies. More specifically, the invention is directed to fence posts for use in such fences. The invention has particular application for intermediate post assemblies that is post assemblies supporting one end of each of two barrier panels extending in substantially opposite direction from the post assembly along the fence line.

BACKGROUND

Typically, intermediate fence post assemblies have comprised of two, substantially identical posts, each of which define a longitudinally extending recess adapted to receive and locate an end of a barrier panel. The posts are arranged in "back to back" relation where outer surfaces of the webs of the respective posts are in abutting relation. Typically each barrier panel comprises upper and lower rigid rails and in-fill means extending from rail to rail. The in-fill means may be an impervious rigid sheet, a roll formed profile sheet, a rigid sheet of expanded metal, a plurality of spaced apart pickets, a sheet of woven wire mesh or other substantially planar obstruction to the passage of people or animals between the posts. Under those circumstances, it is typically the ends of the rails that enter the post assembly recesses and are affixed to the respective posts.

SUMMARY OF THE INVENTION

In a first aspect of the invention there is provided a fence post having a web and locating elements for engagement with an end portion of a barrier panel, the web having opposite inner and outer surfaces and being profiled to facilitate alignment of the fence post with another said post when those posts are arranged in back to back relation with the outer surfaces of the webs in abutting relation, and wherein the web incorporates at least one longitudinal groove that in use provides a channel between the abutting webs.

In at least one form, the web is profiled to include at least one rib, the rib being arranged to at least partially rest in a respective corresponding said rib of another said post when the posts are arranged in back to back abutment to facilitate alignment of the abutting posts In a particular embodiment, the web is profiled to include at least one inwardly directed said rib, and at least one outwardly directed said rib.

In one particular form of the above arrangement, the inwardly directed rib is deeper than the outwardly directed rib so a respective channel is formed between the nesting ribs. The channel can facilitate drainage of water from between the abutting posts. In one form, a transition region is formed between the ribs, the transition region incorporating a flat bearing surface that extends at an angle to a notional reference plane of the web. In this form, the flat bearing surface provides a primary contacting point between the abutting webs which thereby facilitates alignment of the fence posts.

In a particular form, the fence post is arranged so that there are multiple bearing surfaces that extend at an angle to the notional reference plane of the web. The use of multiple bearing surfaces further facilitates the location of the fence posts in correct alignment. In particular it may prevent any inadvertent skewing of the aligned fence posts which may otherwise occur with a single lateral bearing surface. In a particular form, the lateral bearing surfaces are provided by the sides of the inwardly and outwardly directed ribs in addition to the transition region disposed between those ribs.

Typically, the aligned fence posts are interconnected by mechanical fasteners such as self drilling, self tapping screws. In a particular form, the web further incorporates a plurality of fastener receiving sections. In one form, these receiving sections are flat and extend generally in the direction of the notional reference plane of the web. In a particular form, where the web is profiled to include the inwardly and outwardly ribs, the fastener receiving sections are disposed on respective outer sides of these ribs.

In a particular form, the fence post is a length of channel comprising the web and two channel flanges, and wherein the channel flanges serve as the locating elements adapted to receive an end part of the barrier panel between them. Accordingly, in at least this embodiment, the invention provides a modification to the fence post web that facilitates alignment of barrier panels with the fence posts to simplify installation of a fence.

In a particular form, the fence post is formed from sheet material which in one form is sheet metal being preferably sheet steel having a corrosion resistant metal coating. In a particular form where the fence post is formed as a length of channel, that post is formed from a role forming process of steel strip. However it is appreciated that the post could be made in any other suitable form such as by a pressing or extruded process or by some combination of those processes.

In a particular form, where the fence post incorporates the channel flanges, those channel flanges incorporate an inwardly directed lip at their distal ends. In a further form, at least one flange incorporates an inwardly directed rib disposed intermediate the web and a distal end of the flange. The profiling of these flanges is arranged to assist in firmly locating the end portions of the barrier panels.

In a further aspect of the invention there is provided a fence post assembly which includes two posts according to any form described above arranged in back to back relation with the outer surfaces of the webs in abutting relation, the webs of the respective fence posts inter-engaging with one another so as to locate those posts in correct alignment.

In yet a further aspect of the invention there is provided a fence incorporating at least one fence post and/or post assembly as described above.

Throughout the claims and following detailed description of preferred embodiments, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The features and advantages of methods of the inventions will become further apparent from the following detailed description of preferred embodiments.

BRIEF DESCRIPTION OF THE ACCOMPANYING DRAWINGS

It is convenient to hereinafter describe an embodiment of the present invention with reference to the accompanying drawings. It is to be appreciated that the particularity of the drawings and the related description is to be understood as not superseding the generality of the preceding broad description of the invention. In the drawings.

DETAILED DESCRIPTION OF PREFERRED EMBODIMENTS OF THE INVENTION

Figure 1:
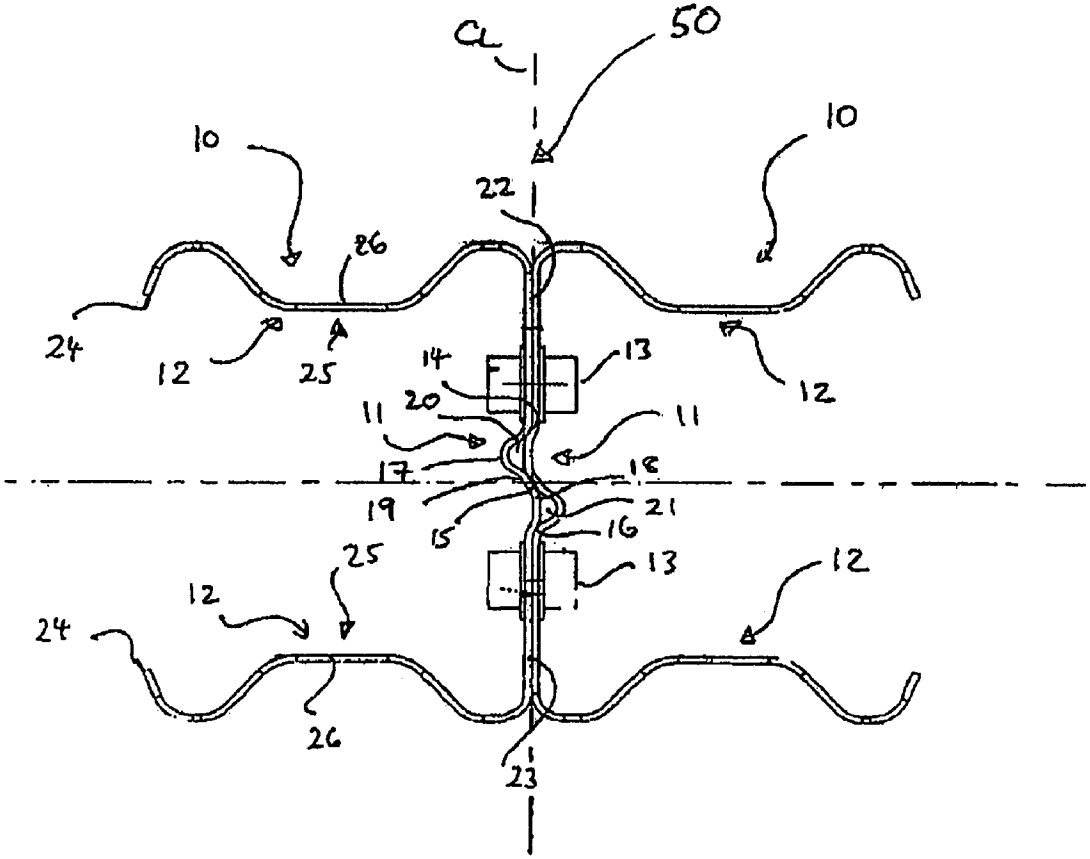
FIG. 1 is an end view of a fence post assembly formed from two fence posts arranged in back to back relation.

Turing firstly to FIG. 1, an intermediate fence post assembly 50 comprises two, identical, fence posts 10 that are arranged in back to back relation. Each post is formed as a channel and comprises a web 11 and two flanges 12, secured together web to web via mechanical fasteners which in the illustrated embodiment are in form of self drilling, self tapping screws 13. In the illustrated form, the posts 10 are formed of roll formed sheet steel which incorporate a corrosion resistant metal coating and which may further include a decorative paint finish.

The fence posts 10 in the assembly 50 are arranged to be in alignment and to facilitate correct alignment of the posts, and the web 11 is profiled so as to provide a plurality of bearing surfaces which extend transverse to a notional reference plane CL which extends in the direction of the webs. As can be seen in the illustrated form, the web 11 of the posts 10 includes three of these transverse bearing surfaces (14, 15 and 16).

In the illustrated form, the web 11 of the fence posts 10 is profiled to include adjacent inwardly directed rib 17 and outwardly directed rib 18. These ribs 17 and 18 are disposed adjacent one another and a transition region 19 which incorporates bearing surface 15 is disposed between those ribs. In addition to the bearing surface 15 formed in the transition region 19, the other two bearing surfaces 14 and 16 are formed by outer side surfaces of the respective ribs 17 and 18.

The ribs 17 and 18 of one post are arranged to nest in the opposite corresponding rib of the other fence post in the assembly 50. In the illustrated form, the ribs 17 and 18 are shaped so that the inwardly directed rib 17 is deeper than the outwardly directed rib so that when one post is aligned with the other post with the ribs partially nesting, longitudinally extending channels 20 and 21 are formed in the nesting ribs. These drainage channels 20 and 21 assist in the prevention of water being trapped between the posts which may limit the service life of the posts.

To facilitate installation of the post assembly, the web incorporates fastener receiving formations 22 and 23 which are disposed on the opposite sides of the adjacent ribs 17 and 18. These fastener receiving formations are in the form of flats which extend in the reference plane CL of the webs. The web 12 is profiled so that the flats of one post are in direct abutment with the flats of the other post in the post assembly 50.

Figure 2:
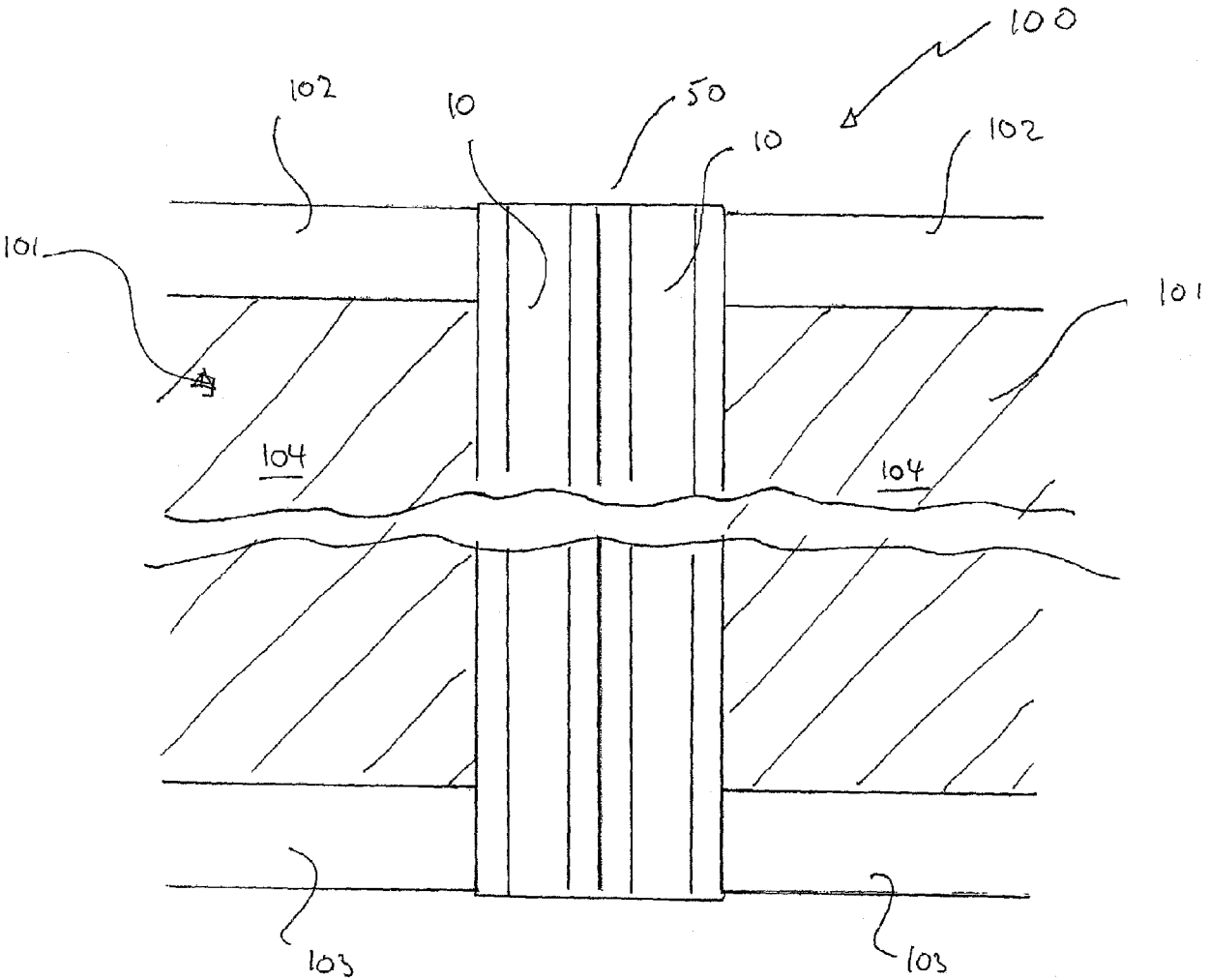
FIG. 2 is a side view of a fence incorporating the fence assembly of FIG. 1.
Figure 3:
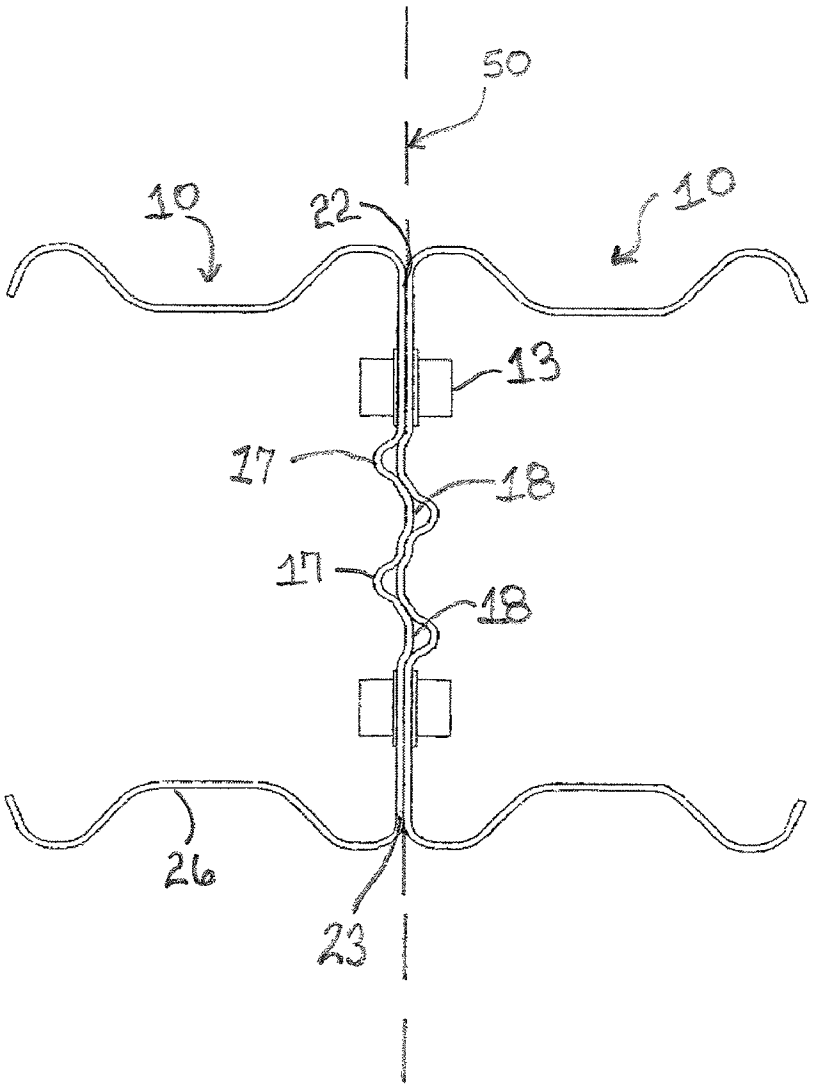
FIG. 3 shows the web of each post comprising more than one inwardly directed rib and more than one outwardly directed rib.

As best illustrated in FIG. 2, the post assembly 50 is used in a fence 100 and is arranged to receive barrier panels 101 which in the illustrated form comprise upper and lower rigid rails 102, 103 and impervious in-fill sheets 104 mounted to those rails. In a typical arrangement, the end portion of the barrier panels 101 are lodged in the channels of the posts 10 where they are held in lateral alignment by the flanges 12. To facilitate the location of the end portion of the barrier panels 101, the flanges 12 incorporate an inwardly turned lip 24 at their distal ends and an intermediate rib 25 which projects inwardly into the channel of the respective posts 10. The inwardly directed channels 25 each include a flat bridging portion 26 which is arranged to receive fasteners (not shown) which are typically used to secure the rails 102, 103 to the respective posts 10.

It will be apparent from the drawings that the posts 10 are necessarily right and left handed. A post of one hand becomes a post of the other hand if and when it is inverted. Its handedness presents no problems when, as is preferred, the fence is effected by onside assemblers using simple lengths of channel section material as starting components. However, if it is desired to provide the site assembler with more fully prefabricated fence components, for example, posts that have been predrilled to take the fasteners, or furnished with rail anchorage lugs within the channel grooves, then those components may have to be designed with a degree of redundancy in respect of those details so that either end of the component may be used equally well as the in-ground end or the top end in the finished fence. If such redundancy is considered undesirable, for example, if the site assembler is provided with post elements, or fully prefabricated posts, with dedicated in-ground and top ends, then it would be necessary to provide the site assembler with stocks of right and left handed items.

In use, the fence posts 10 with the modified webs assists the site assembler with alignment of the fence posts in back to back relation to form an assembled post assembly 50. Further the profiling of the post webs with multiple transverse bearing surfaces (14, 15, 16) ensure that the posts do not become inadvertently skewed along their length as may otherwise occur if there is only one transverse bearing surface. Furthermore with the rib profiles in the web being of different depth, drainage channels are provided which assist in the service life of the assembly 50.

Although the invention has been described with reference to particular embodiments, it will be appreciated by those skilled in the art that numerous variations and/or modifications can be made without departing from the spirit or scope of the invention as broadly described.

For instance, rather than being provided with an inwardly directed rib 17 and an outwardly directed rib 18, a fence post 10 can be provided which incorporates only an inwardly rib 17 or outwardly directed rib 18 adapted to nest in a corresponding rib of another fence post 10 as described above thereby forming only a single drainage channel 20 or 21 between the posts 10 when in back to back abutment. Similarly, a post 10 can be provided with more than two of ribs 17,18.

All such variations and/or modifications are to be considered within the scope of the present invention. The present embodiments are, therefore, to be considered in all respects as illustrative and not restrictive.

The invention claimed is:

1. A first fence post and a second fence post each having a web and locating elements for engagement with an end portion of a first barrier panel and second barrier panel, the web of each fence post having opposite inner and outer surfaces and being profiled to include an inwardly directed rib, and an outwardly directed rib, the inwardly directed rib and outwardly directed rib of the first fence post are at least partially nested in a corresponding outwardly directed rib and inwardly directed rib of the second fence post, respectively, when the first and second fence posts are arranged with the outer surfaces of the web of each fence post in abutment to facilitate alignment of the abutting first and second fence posts; and wherein each of the inwardly directed ribs extends from its respective web for a greater distance than each of the corresponding outwardly directed ribs to form drainage channels therebetween when the first fence post is in abutment with the second fence post.

2. The first and second fence posts according to claim 1, wherein a transition region is formed between said inwardly and outwardly directed ribs of each post, said transition region incorporating a flat bearing surface that extends at an angle to a notional reference plane of the web.

3. The first and second fence posts according to claim 2 wherein the web of each post further incorporates a plurality of fastener receiving sections that extend generally in the direction of a notional reference plane of the web.

4. The first and second fence posts according to claim 3, wherein the fastener receiving sections are disposed on respective outer sides of the inwardly directed rib and outwardly directed rib of each post.

5. The first and second fence posts according to claim 1, wherein the first and second fence posts are formed from sheet material.

6. The first and second fence posts according to claim 5 , wherein the first and second fence posts are formed from sheet metal.

7. The first and second fence posts according to claim 6, wherein the sheet metal is sheet steel having a corrosion resistant metal coating.

8. The first and second fence posts according to claim 5, wherein the post is formed from roll formed steel strip.

9. The first and second fence posts according to claim 1, wherein the post is a length of channel comprising the web and two channel flanges, the channel flanges serving as the locating elements and being adapted to receive an end portion of a barrier panel between them.

10. The first and second fence posts according to claim 9, wherein each flange of each post incorporates an inwardly directed lip at its distal end.

11. The first and second fence posts according to claim 9, wherein the flange incorporates an inwardly directed rib disposed intermediate the web and a distal end of that flange.

12. A fence post assembly comprising the first and second fence posts according to claim 1 arranged with the outer surfaces of the web of each post in abutting relation;

wherein the first fence post is shaped identically to the second fence post and the second fence post is inverted.

13. The first and second fence posts assembly according to claim 12 wherein the drainage channels formed between the respective inwardly and outwardly directed ribs have cross sectional areas of less than 5 square millimeters each.

14. A fence incorporating a plurality of the first and second fence posts according to claim 1, the fence comprising:

barrier panels disposed between, and supported by, adjacent first and second fence posts.

15. The first and second fence posts according to claim 1 wherein the outwardly directed rib projects from the web by less than 2 millimeters.

16. The first and second fence posts according to claim 1, wherein the web of each post comprises more than one inwardly directed rib and more than one outwardly directed rib.

* * * * *